US011925250B2

(12) United States Patent
Zheng et al.

(10) Patent No.: US 11,925,250 B2
(45) Date of Patent: Mar. 12, 2024

(54) COSMETIC APPLICATOR

(71) Applicant: APR Beauty Group, Inc., Toronto (CA)

(72) Inventors: Min-Yan Zheng, Toronto (CA); Feng-Ying Fu, Markam (CA)

(73) Assignee: APR Beauty Group, Inc., Toronto (CA)

( * ) Notice: Subject to any disclaimer, the term of this patent is extended or adjusted under 35 U.S.C. 154(b) by 483 days.

(21) Appl. No.: 17/181,240

(22) Filed: Feb. 22, 2021

(65) Prior Publication Data

US 2022/0265028 A1 Aug. 25, 2022

(51) Int. Cl.
*A45D 40/26* (2006.01)

(52) U.S. Cl.
CPC ..... *A45D 40/267* (2013.01); *A45D 2200/10* (2013.01)

(58) Field of Classification Search
CPC ..... A47L 13/16; A46B 9/005; A46B 9/021; A46B 2200/1046; A46B 2200/1053; A46B 11/00; A45D 34/041; A45D 34/042; A45D 34/043; A45D 34/045; A45D 34/046; A45D 40/261; A45D 40/262; A45D 40/265; A45D 40/267; A45D 40/28; A45D 2200/10; A45D 2200/1009; A45D 2034/007; A45D 2034/04; A45D 2040/0012; A45D 2040/26; A45D 2040/264; A45D 2200/1072; A61H 7/002; A61H 7/003; A61H 7/004; A61H 7/007; A61H 15/0092; A61H 15/0085;

(Continued)

(56) References Cited

U.S. PATENT DOCUMENTS 655,490 A * 8/1900 Hollem ..... A61H 7/003 601/135
915,251 A * 3/1909 Vanderslice ..... A61H 7/003 601/135

(Continued)

FOREIGN PATENT DOCUMENTS

DE 102011054507 A1 * 4/2013 ..... A45D 34/04

OTHER PUBLICATIONS

Tina Beck, "DE 102011054507 A1 translated version" (Year: 2013).*

*Primary Examiner* — Jacqueline T Johanas
*Assistant Examiner* — Holly T. To
(74) *Attorney, Agent, or Firm* — Jason Lee DeFrancesco

(57) ABSTRACT

A cosmetic applicator for applying a product including a cosmetic, care or pharmaceutical product onto the keratinous substrate. The cosmetic applicator comprises an applying member and a shank. The applying member comprises a first application face and a second application face opposite to the first application face, a first peripheral edge, and a second peripheral edge opposite the first peripheral edge. The applying member has a plurality of bulged portions on the second application face and a corresponding plurality of depressed portions on the first application face. The plurality of bulged portions extend from the first peripheral edge towards a central longitudinal axis of the applying member but do not extend up to the second peripheral edge. Each of the plurality of bulged portions has an arched structure, and each of the plurality of depressed portion has a concave bowl structure.

19 Claims, 7 Drawing Sheets

(58) Field of Classification Search
CPC ..... A61H 39/04; A61B 17/244; A61J 17/02; A61M 35/003; A61M 35/006
USPC ..... 132/318, 320, 218, 313, 317, 901; D28/7; 15/207.2; 604/309, 289; 601/109, 111, 114, 103
See application file for complete search history.

(56) References Cited

U.S. PATENT DOCUMENTS 1,405,279 A * 1/1922 Cassedy ..... A46B 9/005 200/84 R
1,569,165 A * 1/1926 Wolf ..... A46B 17/00 15/167.1
1,826,943 A * 10/1931 Maker ..... A61J 17/02 606/235
1,860,924 A * 5/1932 Cooke ..... A46B 7/06 15/167.1
1,892,068 A * 12/1932 Metzler ..... A61H 13/00 601/139
1,965,861 A * 7/1934 Schneider ..... A61H 7/003 D24/215
1,999,642 A * 4/1935 Shepherd ..... B65D 51/32 15/236.01
2,016,597 A * 10/1935 Drake ..... A61C 15/02 15/105
2,092,438 A * 9/1937 Verne ..... A46B 9/005 15/210.1
2,099,030 A * 11/1937 Morrison ..... B44D 2/00 132/320
2,148,483 A * 2/1939 Love ..... A61H 13/00 601/141
2,230,171 A * 1/1941 Besser ..... A46B 9/04 15/167.1
2,405,029 A * 7/1946 Gallanty ..... A61B 17/244 15/167.1
2,419,896 A * 4/1947 Hobelmann ..... A46B 5/04 206/229
2,476,201 A * 7/1949 Ligoure ..... A46B 9/005 15/207.2
2,512,059 A * 6/1950 Haeusser ..... A61H 13/00 15/176.1
2,532,116 A * 11/1950 Monaco ..... A63H 5/00 446/419
2,604,105 A * 7/1952 Kruck ..... A45D 40/26 132/320
2,642,604 A * 6/1953 Ferrari ..... A61H 13/00 15/167.1
2,677,843 A * 5/1954 Goodman ..... A61C 17/00 15/236.08
2,711,731 A * 6/1955 Krohne ..... A61F 13/041 D24/211
3,071,476 A * 1/1963 Werft ..... A61C 17/00 426/115
D206,641 S * 1/1967 Hill ..... 401/268
3,477,435 A * 11/1969 Artelli ..... A61B 17/244 15/236.05
3,491,396 A * 1/1970 Granieri, Jr. ..... A46B 3/005 15/104.94
3,939,522 A * 2/1976 Shimizu ..... A61H 13/00 15/244.1
4,083,078 A * 4/1978 Shimizu ..... A61H 13/00 15/244.1
4,149,815 A * 4/1979 Kawam ..... A61K 8/02 15/104.93
4,205,664 A * 6/1980 Baccialon ..... A61H 13/00 601/141
4,356,585 A * 11/1982 Protell ..... A46B 9/04 15/167.1
D269,126 S * 5/1983 Jedzinak ..... D28/7
4,976,276 A * 12/1990 Avery ..... A45D 20/12 132/270
5,040,260 A * 8/1991 Michaels ..... A46D 1/00 15/207.2
5,312,197 A * 5/1994 Abramson ..... A46B 11/00 401/11
5,888,005 A * 3/1999 Gueret ..... A45D 34/046 401/128
5,955,125 A * 9/1999 Hoeting ..... A23G 3/50 221/24
6,015,293 A * 1/2000 Rimkus ..... A46B 15/0055 433/141
6,067,997 A * 5/2000 Gueret ..... A46B 9/021 132/218
6,077,239 A * 6/2000 Lin ..... A61H 7/003 601/134
6,205,611 B1 * 3/2001 Vigil ..... A46B 11/0003 206/439
6,220,254 B1 * 4/2001 Gueret ..... A45D 40/267 132/218
7,918,619 B2 * 4/2011 Gueret ..... A45D 40/262 401/128
D643,151 S * 8/2011 Limongi ..... D28/7
8,745,807 B2 * 6/2014 Varner ..... A46B 5/02 15/187
D744,161 S * 11/2015 Urrechaga ..... D28/7
9,452,103 B1 * 9/2016 Smallwood ..... A61H 7/003
10,314,380 B2 * 6/2019 Schreiber ..... A46B 9/021
10,532,455 B1 * 1/2020 Krok ..... B25G 1/102
10,575,621 B1 * 3/2020 Pires ..... A45D 19/0066
D925,120 S * 7/2021 Lampe ..... D28/7
D934,494 S * 10/2021 Tullney ..... D28/7
D937,051 S * 11/2021 Lowsky ..... D7/653
11,185,145 B1 * 11/2021 Zheng ..... A45D 33/00
D949,473 S * 4/2022 Bianco ..... D28/7
D966,536 S * 10/2022 Fernandez ..... D29/122
11,633,030 B1 * 4/2023 Lin ..... A45D 34/045 401/191
2002/0005209 A1 * 1/2002 Gueret ..... A45D 40/264 132/218
2002/0124860 A1 * 9/2002 Gueret ..... A46B 3/18 132/218
2003/0108846 A1 * 6/2003 Hoertsch ..... A46B 9/005 15/210.1
2003/0235454 A1 * 12/2003 Gueret ..... A45D 40/267 401/122
2004/0018037 A1 * 1/2004 Gueret ..... A46D 1/0238 401/122
2004/0161285 A1 * 8/2004 Gueret ..... A45D 34/04 401/122
2004/0230147 A1 * 11/2004 Fretterd ..... A61H 7/003 601/135
2005/0069372 A1 * 3/2005 Hohlbein ..... A61B 17/244 401/268
2005/0217691 A1 * 10/2005 Petit ..... A46B 9/021 132/320
2005/0283931 A1 * 12/2005 Endo ..... A47L 13/46 15/210.1
2006/0013639 A1 * 1/2006 Gueret ..... A45D 34/045 401/122
2006/0186145 A1 * 8/2006 Rager ..... B65D 1/0261 222/534
2006/0242780 A1 * 11/2006 Yang ..... A46B 5/04 15/227
2007/0017544 A1 * 1/2007 Gueret ..... A45D 40/267 132/320
2007/0181143 A1 * 8/2007 Montoli ..... A45D 34/04 132/320
2008/0196740 A1 * 8/2008 Velho ..... A45D 27/04 132/289
2009/0130637 A1 * 5/2009 Pantangco, III ..... A61B 17/244 433/216
2010/0240003 A1 * 9/2010 Fritze ..... A46B 9/005 433/80
2011/0168198 A1 * 7/2011 Polanish ..... A46B 1/00 132/73
2011/0257474 A1 * 10/2011 Howard ..... A45D 34/04 2/163

(56) References Cited

U.S. PATENT DOCUMENTS

| | | | | |
|---|---|---|---|---|
| 2011/0308031 | A1* | 12/2011 | Hartstock | A46B 3/005 15/171 |
| 2014/0250620 | A1* | 9/2014 | Screen | A45D 40/28 15/244.1 |
| 2015/0027495 | A1* | 1/2015 | Xavier | A46B 17/06 134/6 |
| 2015/0040943 | A1* | 2/2015 | Dunn | A61M 35/006 15/104.93 |
| 2016/0166045 | A1* | 6/2016 | Nesbitt | A45D 33/006 401/129 |
| 2016/0287466 | A1* | 10/2016 | Bampton | A61H 7/003 |
| 2017/0311694 | A1* | 11/2017 | Tarling | A45D 34/04 |
| 2018/0242764 | A1* | 8/2018 | Wynne | A61J 9/0623 |
| 2018/0279740 | A1* | 10/2018 | Kukreja | A45D 40/265 |
| 2019/0335875 | A1* | 11/2019 | Volin | A45D 24/02 |
| 2020/0329845 | A1* | 10/2020 | Bianco | A45D 34/046 |
| 2021/0076799 | A1* | 3/2021 | Seo | A45D 40/264 |
| 2021/0161286 | A1* | 6/2021 | Hirai | A46D 1/04 |
| 2021/0315361 | A1* | 10/2021 | Zheng | A45D 40/265 |
| 2022/0061497 | A1* | 3/2022 | Bickford | A45D 34/042 |
| 2022/0061502 | A1* | 3/2022 | Bickford | A45D 34/046 |
| 2023/0330708 | A1* | 10/2023 | Jones | A47L 13/16 |

* cited by examiner

COSMETIC APPLICATOR

BACKGROUND

Field

The present disclosure generally relates to a cosmetic applicator for applying a product including a cosmetic, care or pharmaceutical product, onto keratinous substrate such as skin, lips, under eyes, eyelids, cheeks, nails or any other part of the body.

Description of the Related Art

Many Cosmetic product applicator assemblies conventionally include a container in which cosmetic products which are flow able or otherwise non-self-sustaining in shape, are packaged and sold. The cosmetic product is transferred and applied from the container by the cosmetic applicator to a user's skin. Generally, the cosmetic applicator is attached to a rod at one end. The rod's other end is connected to a cap suitable for being attached to a neck of the container. When the cap is attached to the neck, the rod and the applicator extend inside the container. The cap serves as a handle for the user when the cosmetic applicator, bearing a quantity of the cosmetic product, is withdrawn from the container and applied to the skin.

In some instances, in order to engage the cosmetic applicator as the cosmetic applicator is withdrawn through the opening, a flexible elastomeric wiper is mounted in the container opening, for removing excess cosmetic product that may be carried from the body of cosmetic product by the cosmetic applicator.

Applicators for cosmetics or other substances, such as drugs, are known in various designs and forms. For example, reference is made to the U.S. Pat. No. 7,677,826 and the U.S. Pat. No. 9,955,770.

Another prior art U.S. Pat. No. 7,677,826 B2 discloses a device may include an applicator including an applicator element that is at least partially elastically deformable and a receptacle configured to contain a Substance to be applied and configured to house the applicator element when not in use. The receptacle may include an opening through which the applicator element passes while the applicator element is being removed from the receptacle. The applicator element may include at least one inner cavity that is defined, at least in part, between at least two branches that are at least partially flocked. An outside cross-section of the applicator element may be large enough for the applicator element to deform while passing through the opening of the receptacle, the deformation resulting in a shape of the cavity being modified.

Another prior art U.S. Pat. No. 9,955,770 discloses an applicator for applying a composition, such as makeup or care product composition, e.g. lip gloss, mascara, eye linear, hair color, and wound care, pharmaceutical or like, that have diverse application characteristics. The applicator comprises an applicator element comprising a support and a layout of fibers on at least a portion of the support, the fibers being flocked to at least portion of the support, the fibers being flocked to at least portion of the support and allow the applicator element to be loaded with the composition. The layout of fibers defines a pattern of fibers on the support and the patterns of fibers is visible to naked eye and perceptible to touch.

Not all known applicators are convenient and designed to apply cosmetic products precisely over a large area and at the same time amounts extensive quantity of cosmetic product for example to the skin.

Thus there is a need for a cosmetic applicator which enables a gentle application while covering a large area during application.

SUMMARY

It is an object of the present disclosure to provide a cosmetic package that can be easily configured to contain a product and a cosmetic applicator.

It is an object of the present disclosure to provide a cosmetic applicator which is very simple to use, economical to manufacture and aesthetically pleasing.

It is an object of the present disclosure to provide a cosmetic applicator which provides a soft feel on skin of a user during application.

Accordingly, there is provided a cosmetic applicator for applying a cosmetic bulk on a keratinous surface like human skin, lips, eyelashes, under eyes, cheeks, or any other part of the body. The cosmetic applicator comprises an applying member at its distal portion and a shank at its proximal portion. The applying member comprises a first application face and a second application face opposite to the first application face. The applying member is provided with a plurality of bulged portions on the second application face and wherein opposite surface of the plurality of bulged portions form a corresponding plurality of depressed portions on the first application face.

According to an aspect of the present disclosure, the applying member further comprises two peripheral edges that bound the first application face and the second application face, the two peripheral edges are namely a first peripheral edge and a second peripheral edge opposite the first peripheral edge. The first peripheral edge and the second peripheral edge converge towards the distal end of the applying member to form a pointed tip.

According to an aspect of the present disclosure, the bulged portions extend from the first peripheral edge towards a central longitudinal axis of the applying member on the second application face. Each bulged portion may have a cross section curve with a varying width along its entire length, and wherein the width of cross section curve of the each bulged portion being maximum near the first peripheral edge. The length of a bulged portion is measured from an edge of the bulged portion closest to the central longitudinal axis of the applying member to an outer edge of said bulged portion.

In an alternate embodiment, each bulged portion may consist of a central wall and a pair of opposing side walls giving the bulged portion a generally trapezoidal cross-section. In yet alternate embodiments, at least one of the bulged portions may a cross section with a substantially equal width along its entire length.

According to yet another aspect of the present disclosure, each bulged portion has a substantially varying height along its entire length and width. In alternate embodiments, however, at least one of the bulged portions may have a substantially constant height along its entire length and width. In the exemplary embodiment, the height of the each of the bulged portions is maximum closest to the first peripheral edge.

According to yet another aspect of the present disclosure, the bulged portions are protruded features which are sculptured from the surface of the second application face. The bulged portions are formed as a reverse portion of the depressed portions of the first application face.

According to yet another aspect of the present disclosure, the plurality of the bulged portions tend to increase the contact area of the second application face of the applying member.

According to yet another aspect of the present disclosure, each bulged portion is convex in shape and each of the depressed portions is in the form a concave cavity that can hold a sufficient amount of bulk. The first application face dispenses the bulk stored in depressed portions during application. More particularly, each bulged portion has an arched structure and each depressed portion is like a hollow bowl that can hold a cosmetic product.

The bulged portions have the massaging capability to give a sensational massage effect when applied to a keratinous surface like human skin, lips, under eyes, cheeks, or any other part of the body. At least one of the bulged portions may have at least one protrusion on its surface capable of providing a soft touch effect when applied on a human skin surface.

Furthermore, the bulged portions and the opposing depressed portions are located such that they are spaced apart from a skirt present at a proximal end of the applying member, and are spaced apart from the tip of the applying member.

According to yet another aspect of the present disclosure, the applying member is substantially planar or flat except in the areas with bulging portions. The planar or flat means the applying member has a width greater than its thickness. Both the first and second application faces, comprising generally partially flat surface that can be used to apply and blend a cosmetic bulk on a keratinous surface like human skin.

At least some portions of the first peripheral edge comprise and define the outer free edges of the bulged portions and the depressed portions of the applying member. The first peripheral edge has a convexly curved profile when seen from along the longitudinal axis from the pointed tip to the skirt of the applying member. The first peripheral edge extends in more than one plane as the bulged portions of the first peripheral edge projects out from a mid-plane in which the rest of the applying member lies.

The second peripheral edge extends from the pointed tip to the skirt of the applying member. The second peripheral edge has a convexly curved profile when seen from along the longitudinal axis from the pointed tip to the skirt of the applying member. The second peripheral edge has a sufficient width such as it can be used to reach the narrow part of the user's body, and thus the second peripheral edge can be used for precision application of the cosmetic bulk on the user's skin.

According to yet another aspect of the present disclosure, the pointed tip of the applying member is off-centered from the central longitudinal axis of the cosmetic applicator. In alternate embodiments, the tip may be rounded and/or may lie on the central longitudinal axis of the cosmetic applicator.

In an embodiment, the free edges of bulged portions on the first peripheral edge are uniformly spaced from one another by flat portions of the applying member, however, in alternate embodiments, they may or may not be uniformly spaced.

The bulged portions may or may not extend in parallel directions. As seen, the bulged portions are substantially non-parallel with one another. Furthermore, according to another aspect, the bulged portions may be different from one another in shape and size.

In an embodiment, the applying member comprises three bulged portions and wherein the free edges of the three bulged portions represent at least 60% of the first peripheral edge, and still better at least 80% of the first peripheral edge. The three bulged portions are of different sizes, wherein a first bulged portion of the three bulged portions is located below the pointed tip of the applying member and a third bulged portion of the three bulged portions is located just above the skirt of the applying member. The second bulged portion of the three bulged portions is located in the area between the first and the second bulged portions of the three bulged portions. The first bulged portion being the largest and the third bulged portion being the smallest in size. More particularly, the width and height of the first bulged portion are greatest among the three bulged portions. The opposing depressed portions of the applying member thus correspond to the shape and size of the corresponding three bulged portions, and thus accordingly three corresponding depressed portions of the applying member have different depths and widths. The storage capacity for holding cosmetic bulk is thus different for each of the three depressed portions according to its size.

According to a further aspect of the present disclosure, there is provided a cosmetic package is equipped with a cosmetic applicator of the present disclosure. The cosmetic package comprises a container having a containing capacity inside for storing the cosmetic bulk, and an applicator comprising a cap to protect the bulk stored inside the container, a shaft connecting the cap to the cosmetic applicator through a shank of the cosmetic applicator. Further, a wiper is provided in a neck of the container to clean the shaft and also remove the extra bulk from the applying member of the cosmetic applicator.

According to an aspect of the present disclosure, the applying member of the cosmetic applicator is flocked with fibers from the pointed tip to the skirt of the applying member. The flocking on the applying member provides both comfort and sensorial feel when applied on the human skin surface. The shank may not be flocked. Preferably, the shank is a flockless structure that extends proximally from the skirt.

The cosmetic bulk is loaded in the depressed portions on the first application face of the applying member when the cosmetic applicator is inserted in the container. When the cosmetic applicator is withdrawn from an opening of the container, the bulged portions of the applying member frictionally contact with the wiper member, and while the cosmetic bulk is retained inside the depressed portions on the opposite sides of the bulged portions.

According to yet another aspect of the present disclosure, the shaft comprises a cavity at a distal end thereof to receive and retain the shank of the applicator head for coupling the applicator head with the shank. The shank of the cosmetic applicator comprises an annular groove that receives a corresponding annular protrusion provided in the cavity of the shaft.

According to an embodiment of the present disclosure, the cosmetic applicator is preferably formed of an elastomeric material e.g. in a material selected from the following list: elastomers; thermoplastic elastomers. However, in alternate embodiments, the cosmetic applicator may be formed from any suitable rigid or flexible material known in the art.

Further, the first application face and the opposing second application face of the cosmetic applicator may also have different surface properties, in particular application properties.

According to an embodiment, container and the cap may be made of a rigid material like glass, metal, plastic or any other material known in the art. However, in alternate embodiments, the container and the cap may be made of a flexible material like flexible polymeric material or any other material known in the art.

According to an embodiment, the container is of an elongated cylindrical configuration. However, in alternate embodiments, the receptacle may be of an elongated square, polygonal configuration, oval, triangular, heart, or any other configuration known in the art.

According to an embodiment of the present disclosure, the shaft can have a longitudinal axis that is rectilinear. However, in alternate embodiments, it could be curved.

According to an embodiment of the present disclosure, a longitudinal axis of the shaft coincides with the central longitudinal axis of the cosmetic applicator. However, in alternate embodiments, the longitudinal axis of the shaft may not coincide with the central longitudinal axis of the cosmetic applicator.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes described herein. As another example, the materials used for various components can be different from those mentioned specifically herein.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
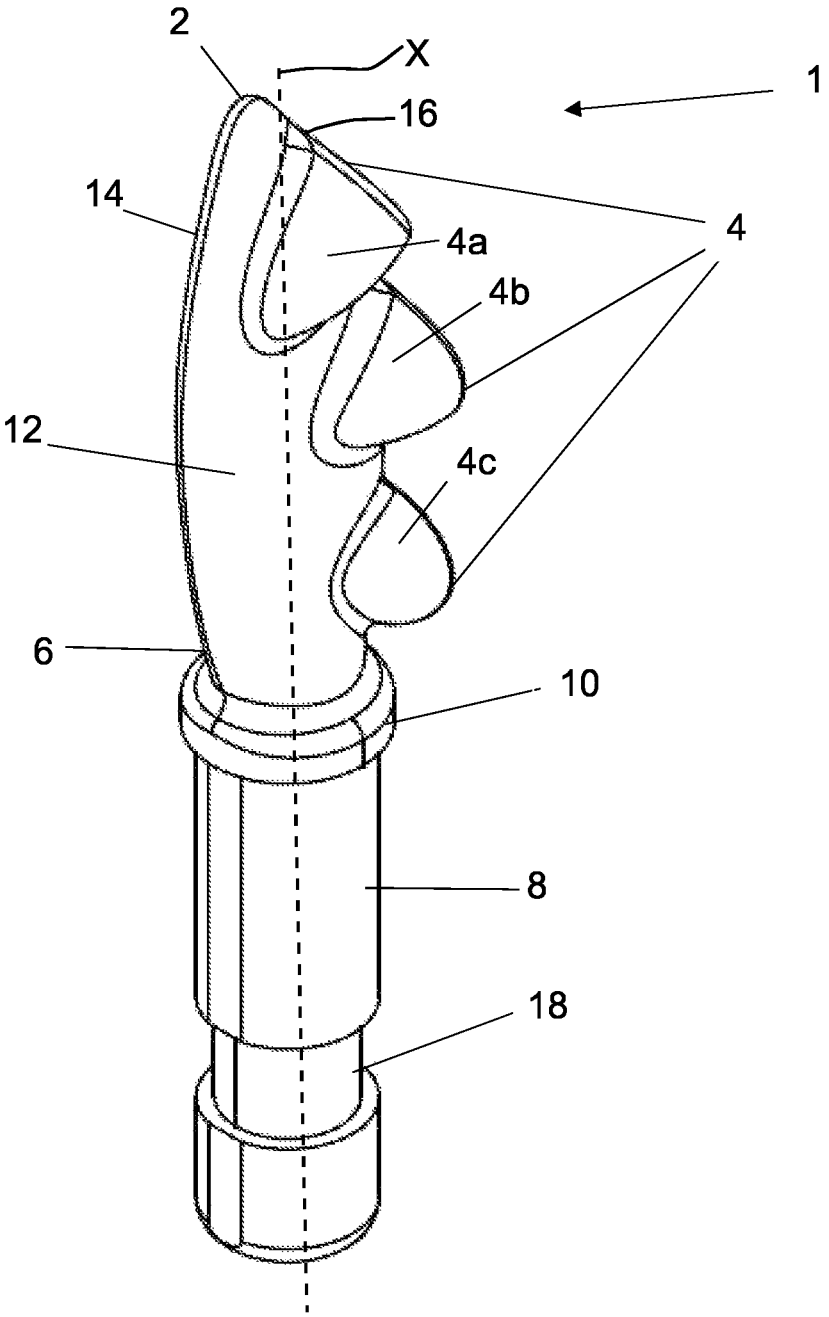
FIG. 1 illustrates an isometric view of a cosmetic applicator of the present disclosure.

As shown throughout the drawings, like reference numerals designate like or corresponding parts.

Throughout this specification, the terms "comprise," "comprises," "comprising" and the like, shall consistently mean that a collection of objects is not limited to those objects specifically recited.

Figure 2:
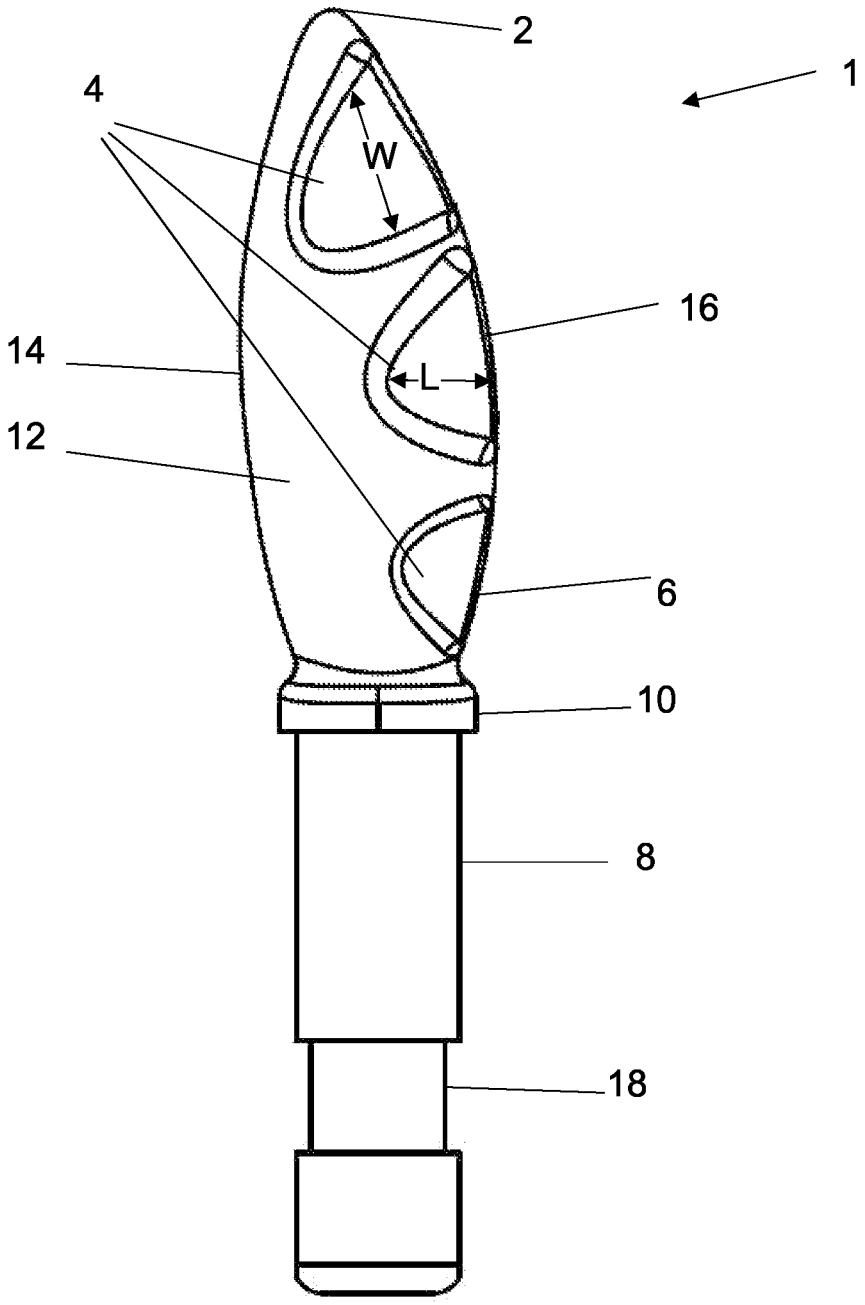
FIG. 2 illustrates the rear view of the cosmetic applicator of FIG. 1.
Figure 3:
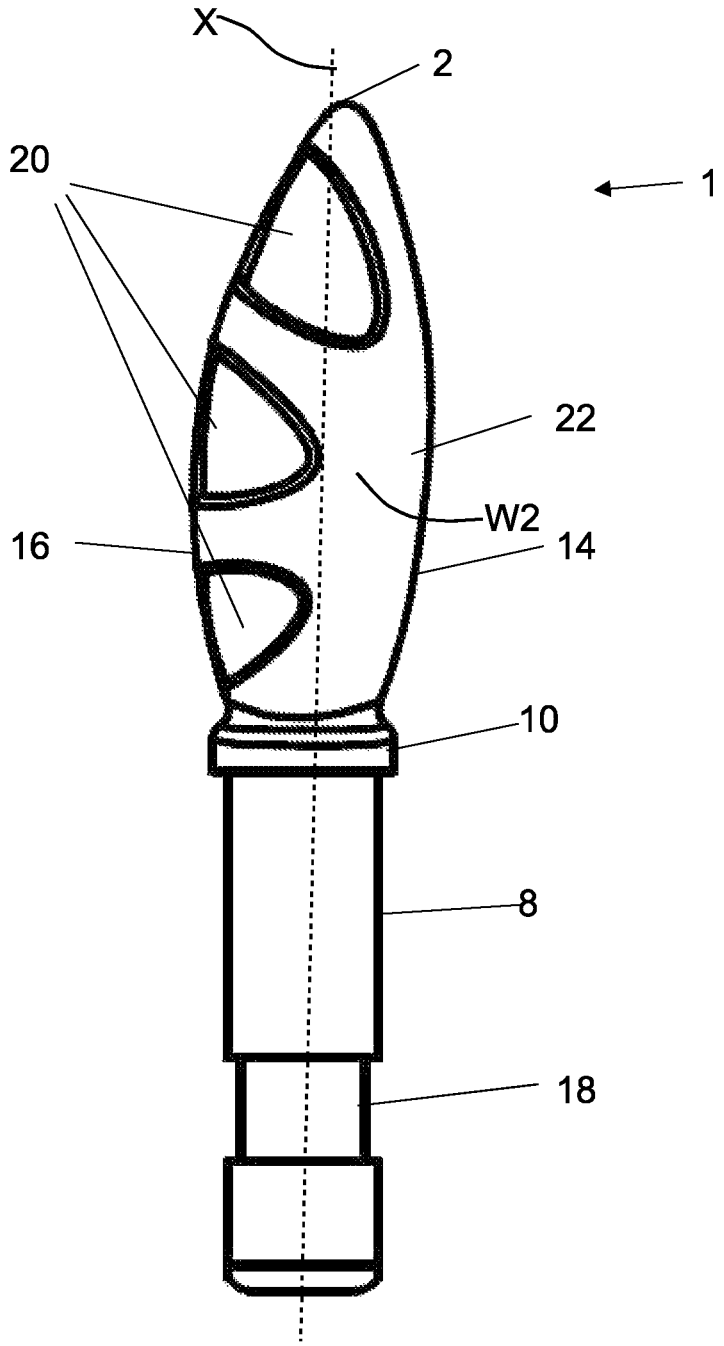
FIG. 3 illustrates the front view of the cosmetic applicator of FIG. 1

FIG. 1 shows the isometric view of the cosmetic applicator 1 that elongates along a central longitudinal axis X (FIG. 2). The cosmetic applicator 1 comprises an applying member 6 at its distal portion and a shank 8 at its proximal portion. The cosmetic applicator 1 is used to apply a cosmetic bulk on a keratinous surface like human skin, lips, eyelashes, under eyes, cheeks, or any other part of the body.

As shown in FIGS. 1-5, the applying member 6 of the cosmetic applicator 1 comprises a first application face 22 and a second application face 12 opposite to the first application face 22. The applying member 6 further comprises two peripheral edges that bound the first application face 22 and the second application face 12, the two peripheral edges are namely a first peripheral edge 16 and a second peripheral edge 14 opposite the first peripheral edge 16. The first peripheral edge 16 and the second peripheral edge 14 converge towards the distal end of the applying member 6 to form a pointed tip 2.

The applying member 6 is provided with a plurality of bulged portions 4 on the second application face 12, and wherein back sides of the bulged portions 4 form a corresponding plurality of depressed portions 20 on the first application face 22. The bulged portions 4 extend from the first peripheral edge 16 towards a central longitudinal axis X of the applying member 6 on the second application face 12.

Figure 4:
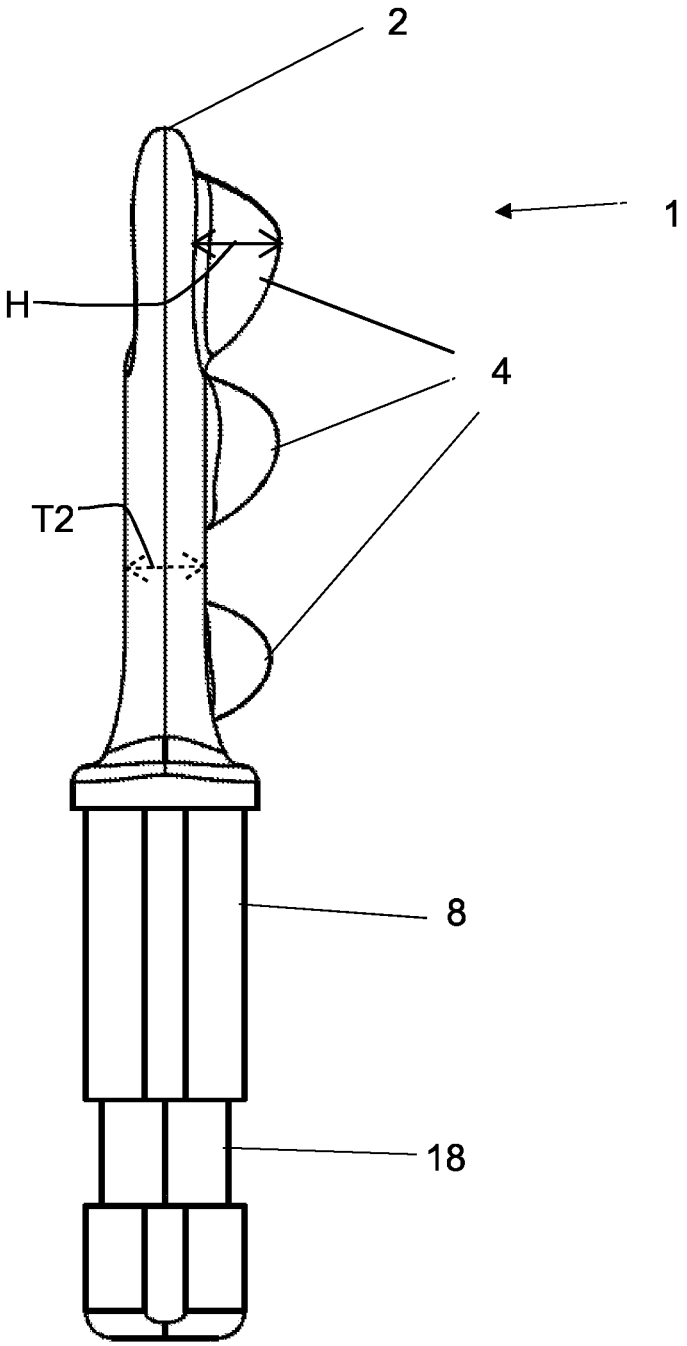
FIG. 4 illustrates a left side view of the cosmetic applicator of FIG. 1.
Figure 5:
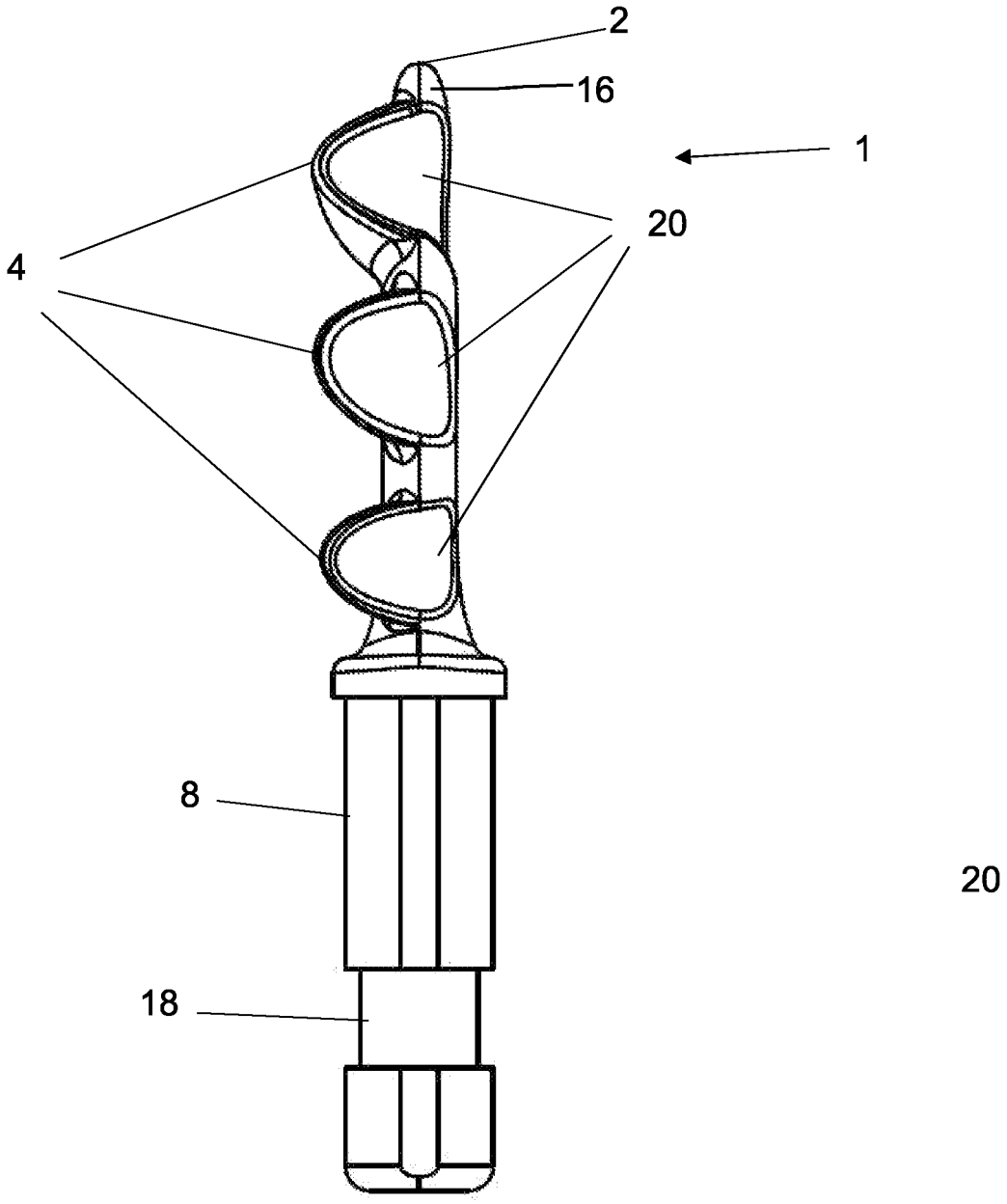
FIG. 5 illustrates a right side view of the cosmetic applicator of FIG. 1.

As seen in FIGS. 1 and 4-5, each bulged portion 4 has a cross section curve with a varying width along its entire length L, and wherein the width W of cross section curve of the each bulged portion being maximum near the first peripheral edge 16. The length L of a bulged portion 4 is measured from an edge of the bulged portion 4 closest to the central longitudinal axis X of the applying member 6 to an outer edge of said bulged portion 4.

In an alternate embodiment, (not shown) each bulged portion 4 may consist of a central wall and a pair of opposing side walls giving the bulged portion 4 a generally trapezoidal cross-section. In yet alternate embodiments, (not shown) at least one of the bulged portions 4 may a cross section with a substantially equal width along its entire length.

Further, as shown FIGS. 1, 2 and 4, in the present embodiment, each bulged portion 4 has a substantially varying height H along its entire length L and width W. In alternate embodiments, (not shown) however, at least one of the bulged portions 4 may have a substantially constant height along its entire length L and width W. In the exemplary embodiment, the height H of the bulged portions 4 is maximum closest to the first peripheral edge 16.

The bulged portions 4 are protruded features which are sculptured from the surface of the second application face 12. The bulged portions 4 are formed as reverse portions of the depressed portions 20 of the first application face 22.

The plurality of the bulged portions 4 tend to increase the contact area of the second application face 12 of the applying member 6.

Further, as clearly visible in FIG. 5 each bulged portion 4 is convex in shape and each of the depressed portions 20 is in the form a concave cavity 20 that can hold a sufficient amount of bulk. The first application face 16 dispenses the bulk stored in depressed portions 20 during application.

The bulged portions 4 have the massaging capability to give a sensational massage effect when applied to a keratinous surface like human skin, lips, under eyes, cheeks, or any other part of the body. At least one of the bulged portions 4 may have at least one protrusion on its surface capable of providing a soft touch effect when applied on a human skin surface.

Furthermore, the bulged portions 4 and the opposing depressed portions 20 are located such that they are spaced apart from a skirt 10 present at a proximal end of the applying member 6, and are spaced apart from the tip 2 of the applying member 6.

The applying member 6 is substantially planar or flat except in the areas with bulging portions 4. The term "planar" or "flat" means the applying member 6 has a width W2 (FIG. 3) greater than its thickness T2 (FIG. 4). Both the first and second application faces 22, 12 comprising generally partially flat surface that can used to apply and blend a cosmetic bulk on keratinous surface like human skin.

At least some portions of the first peripheral edge 16 comprise and define the outer free edges of the bulged portions 4 and the depressed portions 20 of the applying member 6. The first peripheral edge 16 has a convexly curved profile when seen from along the longitudinal axis X from the pointed tip 2 to the skirt 10 of the applying member 6. The first peripheral edge 16 extends in more than one plane as the bulged portions of the first peripheral edge 16 projects out from a mid-plane in which the rest of the applying member 6 lies.

The second peripheral edge 14 extends from the pointed tip 2 to the skirt 10 of the applying member 6. The second peripheral edge 14 has a convexly curved profile when seen from along the longitudinal axis X from the pointed tip 2 to the skirt 10 of the applying member 6. The second peripheral edge 14 has a sufficient width such as it can be used to reach at the narrow part of the user's body, and thus the second peripheral edge 14 can be used for precision application of the cosmetic bulk on the user's skin.

As shown in FIG. 1, the pointed tip 2 is off-centered from the central longitudinal axis X of cosmetic applicator 1. In alternate embodiments, (not shown) the tip may be rounded and/or may lie on the central longitudinal axis X of the cosmetic applicator 1.

In the exemplary embodiment, referring FIGS. 2 and 5, the free edges of the bulged portions 4 on the first peripheral edge 16 are uniformly spaced from one another by flat portions of the applying member 6, however, in alternate embodiments, they may or may not be uniformly spaced.

The bulged portions 4 may or may not extend in parallel directions. As seen in FIG. 2, the bulged portions are substantially non-parallel with one another. Furthermore, according to another aspect, the bulged portions 4 may be different from one another in shape and size.

In the exemplary embodiment, the applying member 6 comprises three bulged portions 4 and wherein the free edges of the three bulged portions 4 represent at least 60% of the first peripheral edge 16, and still better at least 80% of the first peripheral edge 16. The three bulged portions 4 are of different sizes, wherein first bulged portions 4*a* of the three bulged portions 4 is located below the pointed tip 2 of the applying member 6 and a third bulged portion 4*c* is located just above the skirt 10 of the applying member 6. The second bulged portion 4*b* is located in the area between the first and the second bulged portions 4*a*, 4*b*. The first bulged portion being the largest and the third bulged portion being the smallest in size. More particularly, the width and the height of the first bulged portion 4*a* are greatest among the three bulged portions 4. The opposing depressed portions 20 of the applying member thus correspond to the shape and size of the corresponding three bulged portions 4, and thus accordingly three corresponding depressed portions 20 of the applying member have different depths and widths. The storage capacity for holding cosmetic bulk is thus different for each of the three depressed portions 20 according to its size.

Figure 7:
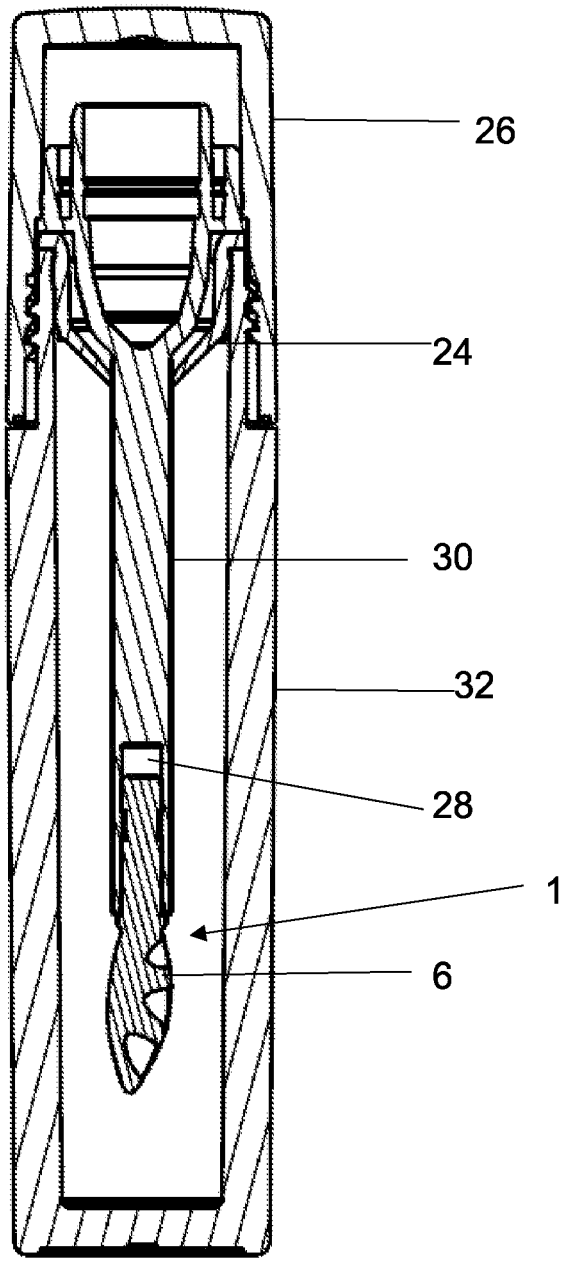

FIG. 7 shows a cosmetic package 100 equipped with a cosmetic applicator having a cosmetic applicator 1 of the present disclosure. The cosmetic package 100 comprises a container 32 having a containing capacity inside for storing the cosmetic bulk, and an applicator comprising a cap 26 to protect the bulk stored inside the container 32, a shaft 30 connecting the cap 26 to the cosmetic applicator 1 through a shank 8 of the cosmetic applicator 1. Further, a wiper 24 is provided in a neck of the container to clean the shaft 30 and also remove the extra bulk from applying member 6 of the cosmetic applicator 1.

Figure 6:
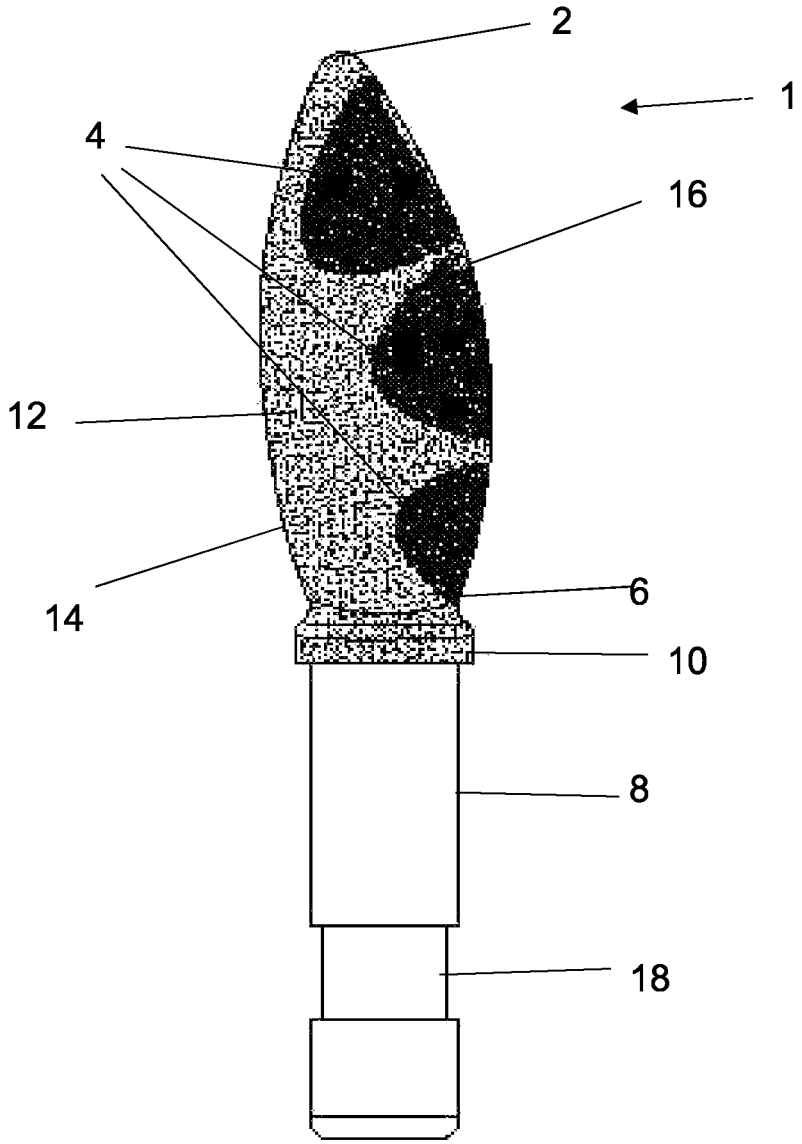
FIG. 6 illustrates the applicator head of FIG. 2 with flocking on a portion of the cosmetic applicator and FIG. 7 illustrates a longitudinal sectional view of a packaging comprising cosmetic applicator of FIG. 1.

According to an aspect of the present disclosure, the applying member of the cosmetic applicator 1 is flocked with fibers from the pointed tip 2 to the skirt 10, see FIG. 6. The flocking on the applying member 6 provides both comfort and sensorial feel when apply on the human skin surface. The shank 8 may not be flocked. In the present embodiment, the shank 8 is a flockless structure that extends proximally from the skirt 10.

The cosmetic bulk is loaded in the depressed portions 20 on the first application face 22 of the applying member 6 when the cosmetic applicator 1 is inserted in the container 32. When the cosmetic applicator 1 is withdrawn from an opening of the container 32, the bulged portions 4 of the applying member 6 frictionally contact with the wiper member 24 and while the cosmetic bulk is retained inside the depressed portions 20 on the opposite sides of the bulged portions 4.

The shaft 30 comprises a cavity 34 at a distal end thereof to receive and retain the shank of the applicator head for coupling the applicator head with the shank 30. The shank 8 of the cosmetic applicator 1 comprises an annular groove 28 that receives a corresponding annular protrusion provided in the cavity of the shaft.

In general, the use of the terms "distal" and "proximal" herein is supposed to mean that the distal side/end is the side/end facing towards the tip 2 of the cosmetic applicator 1, whereas the proximal side/end is the side/end downward and away from the pointed tip 2.

According to an embodiment of the present disclosure, the cosmetic applicator is preferably formed of an elastomeric material e.g. in a material selected from the following list: elastomers; thermoplastic elastomers. However, in alternate embodiments, the cosmetic applicator may be formed from any suitable rigid or flexible material known in the art.

While illustrative embodiments of the present disclosure have been described and illustrated above, it should be understood that these are exemplary of the disclosure and are not to be considered as limiting. Additions, delbetions, substitutions, and other modifications can be made without departing from the spirit or scope of the present disclosure. Accordingly, the present disclosure is not to be considered as limited by the foregoing description.

What is claimed is:

1. A cosmetic applicator for applying a cosmetic product on a keratinous surface, the cosmetic applicator comprising:

an applying member at a distal portion of the cosmetic applicator;

a shank at a proximal portion of the cosmetic applicator;

wherein the applying member comprises a first application face and a second application face opposite to the first application face;

wherein the applying member further comprises a first peripheral edge and a second peripheral edge opposite the first peripheral edge;

wherein the first peripheral edge and the second peripheral edge together bound the first application face and the second application face;

wherein the applying member has a plurality of bulged portions on the second application face and a corresponding plurality of depressed portions on the first application face;

wherein each of the plurality of depressed portions defines a back surface of respective of the plurality of bulged portions;

wherein the plurality of bulged portions extend from the first peripheral edge towards a central longitudinal axis of the applying member on the second application face, but do not extend up to the second peripheral edge;

wherein each of the plurality of bulged portions is convex in shape, and wherein each of the plurality of depressed portions is in the form a concave cavity that can hold a quantity of cosmetic product;

wherein the applying member is planar, except for the area near the first peripheral edge, where the applying member includes the plurality of bulged portions and the plurality of depressed portions;

wherein only the second application face has the plurality of bulged portions, while the first application face is free of bulged portions;

wherein a free edge of each of the plurality of bulged portions define a portion of the first peripheral edge;

wherein each of the plurality of bulged portions elevates from the second application surface in a direction orthogonal to a plane containing the second application face and reaches a maximum height at the free edge thereof;

wherein at least a few portions of the first peripheral edge that is defined by the free edges of the plurality of bulged portions, each exhibit a convex curvature in a plane perpendicular to the plane containing the second application face;

wherein other portions of the first peripheral edge align with the same plane as the second application face;

wherein flat portions of the applying member separate free edges of the plurality of bulged portions along the first peripheral edge;

wherein a maximum height of at least one bulged portion of the plurality of bulged portions is greater than a maximum thickness of the applying member; and wherein flocking is applied to both the first application face and the second application face of the applying member, encompassing both the plurality of bulged portions and the plurality of depressed portions.

2. The cosmetic applicator according to claim 1, wherein the first peripheral edge and the second peripheral edge converge towards a distal end of the applying member to form a pointed tip at the distal end.

3. The cosmetic applicator according to claim 1, wherein width of each of the plurality of bulged portions varies along an entire length of the bulged portion, and wherein the width of the each of the plurality of bulged portions is maximum near the first peripheral edge.

4. The cosmetic applicator according to claim 1, wherein a maximum height of at least one of the plurality of bulged portions is at least twice a thickness of the applying member.

5. The cosmetic applicator according to claim 1, wherein each of the plurality of bulged portions has a varying height along an entire length and width of the bulged portion.

6. The cosmetic applicator according to claim 1, wherein each of the bulged portions has an arched structure and each of the plurality of depressed portions has bowl like structure.

7. The cosmetic applicator according to claim 1, wherein the plurality of the bulged portions and the plurality of the depressed portions are spaced apart from both a proximal end and a distal end of the applying member.

8. The cosmetic applicator according to claim 1, wherein a tip of the applying member is off-centered from the central longitudinal axis of the cosmetic applicator.

9. The cosmetic applicator according to claim 1, wherein the first peripheral edge extends in more than one plane.

10. The cosmetic applicator according to claim 1, wherein the plurality of bulged portions are non-parallel with one another.

11. The cosmetic applicator according to claim 1, wherein the plurality of bulged portions differ from one another in size.

12. The cosmetic applicator according to claim 1, wherein free edges of the plurality of bulged portions represent at least 60% of the first peripheral edge of the applying member.

13. The cosmetic applicator according to claim 1, wherein the cosmetic applicator is configured to be used with a cosmetic package, and wherein the cosmetic package comprises a container for storing the cosmetic product, and an applicator comprising a cap, a shaft connected to the cap at one end and to the cosmetic applicator at the other end.

14. A cosmetic applicator for applying a cosmetic product on a keratinous surface, the cosmetic applicator comprising:

an applying member at a distal portion of the cosmetic applicator;

a shank at a proximal portion of the cosmetic applicator;

wherein the applying member comprises a first application face and a second application face opposite to the first application face;

wherein the applying member further comprises a first peripheral edge and a second peripheral edge opposite the first peripheral edge;

wherein the first peripheral edge and the second peripheral edge together bound the first application face and the second application face;

wherein the second application face includes three bulged portions, namely, a first bulged portion, a second bulged portion and a third bulged portion;

wherein the first application face includes three depressed portions, namely a first depressed portion, a second depressed portion, and a third depressed portion;

wherein the three depressed portions are defined by backside of the corresponding three bulged portions;

wherein the three bulged portions extend from the first peripheral edge towards a central longitudinal axis of the applying member on the second application face, but do not extend up to the second peripheral edge;

wherein free edges of the three bulged portions comprise at least 60% of the first peripheral edge;

wherein the free edge of each of the three bulged portions define a portion of the first peripheral edge;

wherein at least a few portions of the first peripheral edge that is defined by the free edges of the three bulged portions, each said free edge exhibit a convex curvature in a plane perpendicular to the plane containing the second application face;

wherein other portions of the first peripheral edge align with the same plane as the second application face;

wherein flat portions of the applying member separate free edges of the three bulged portions along the first peripheral edge;

wherein the three bulged portions rise from the second application face in a direction orthogonal to a plane containing the second application face;

wherein a maximum height of at least one bulged portion of the three of bulged portions is greater than a maximum thickness of the applying member; and wherein each of the three bulged portions is arched shape, and each of the three depressed portion is concave bowl shape.

15. The cosmetic applicator according to claim 14, wherein the first bulged portion is located just below a distal end of the applying member and the third bulged portion is located just above a proximal end of the applying member.

16. The cosmetic applicator according to claim 15, wherein the first bulged portion is largest in size amongst the three bulged portions, and wherein the third bulged portion is the smallest in size amongst the three bulged portions.

17. The cosmetic applicator according to claim 15, wherein the height of at least one of the bulged portion of the three bulged portions varies along an entire length and width of the bulged portion.

18. The cosmetic applicator according to claim 15, wherein the three bulged portions define at least 30% of a total area of the second application face of the applying member.

19. A cosmetic applicator for applying a cosmetic product on a keratinous surface, the cosmetic applicator comprising:

an applying member at a distal portion of the cosmetic applicator;

a shank at a proximal portion of the cosmetic applicator;

wherein the applying member comprises a first application face and a second application face opposite to the first application face;

wherein the applying member further comprises a first peripheral edge and a second peripheral edge opposite the first peripheral edge;

wherein the first peripheral edge and the second peripheral edge together bound the first application face and the second application face;

wherein at least one of the first application face and the second application face includes at least two bulged portions;

wherein the other of the at least one of the first application face and the second application face at least two depressed portions, wherein the at least two depressed portions are defined by backside of the corresponding at least two bulged portions;

wherein the at least two bulged portions extend from one of the first peripheral edge and the second peripheral edge towards a central longitudinal axis of the applying member but do not extend up to a complete width of the applying member;

wherein the applying member is planar, except for the area near the first peripheral edge, where the applying member includes the at least two bulged portions and at least two depressed portions;

wherein the free edge of each of the at least two bulged portions define a portion of the first peripheral edge;

wherein at least a few portions of the first peripheral edge that is defined by the free edges of the at least two bulged portions, each said free edge exhibit a convex curvature in a plane perpendicular to the plane containing the second application face;

wherein other portions of the first peripheral edge align with the same plane as the second application face;

wherein the at least two bulged portions rise from the second application face in a direction orthogonal to a plane containing the second application face;

wherein each of at least two bulged portions elevates from the second application surface to reach a maximum height at the first peripheral edge;

wherein a maximum height of at least one bulged portion of the at least two bulged portions is greater than a maximum thickness of the applying member; and wherein each of the at least two bulged portions has an arched structure, and each of the at least two depressed portions has concave bowl structure.

* * * * *